US012168914B2

(12) United States Patent
Albassam et al.

(10) Patent No.: US 12,168,914 B2
(45) Date of Patent: Dec. 17, 2024

(54) SYSTEMS AND METHODS OF PRODUCTION TUBING CHEMICAL INJECTION

(71) Applicant: SAUDI ARABIAN OIL COMPANY, Dhahran (SA)

(72) Inventors: Abdulaziz Khaled Albassam, Tanajib (SA); Wail Khalid Aljehani, Tanajib (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/167,014

(22) Filed: Feb. 9, 2023

(65) Prior Publication Data

US 2024/0271505 A1 Aug. 15, 2024

(51) Int. Cl.

| | |
|---|---|
| ***E21B 43/12*** | (2006.01) |
| ***E21B 33/068*** | (2006.01) |
| ***E21B 34/10*** | (2006.01) |
| ***E21B 37/06*** | (2006.01) |

(52) U.S. Cl.

CPC ..... *E21B 37/06* (2013.01); *E21B 33/068* (2013.01); *E21B 34/10* (2013.01); *E21B 43/126* (2013.01); *E21B 43/128* (2013.01)

(58) Field of Classification Search

CPC ..... E21B 33/068; E21B 43/126
USPC ..... 166/304
See application file for complete search history.

(56) References Cited

U.S. PATENT DOCUMENTS

| | | | | |
|---|---|---|---|---|
| 7,913,754 | B2 * | 3/2011 | Bolding | E21B 33/068 166/263 |
| 8,408,314 | B2 * | 4/2013 | Patel | E21B 37/06 166/373 |
| 10,119,364 | B2 * | 11/2018 | Flores | E21B 34/142 |
| 10,697,272 | B2 * | 6/2020 | Falk | E21B 33/127 |
| 2017/0030173 | A1 * | 2/2017 | MacPhail | E21B 43/16 |

* cited by examiner

*Primary Examiner* — William D Hutton, Jr.
*Assistant Examiner* — Ashish K Varma
(74) *Attorney, Agent, or Firm* — Vorys, Sater, Seymour and Pease LLP

(57) ABSTRACT

A well system includes a wellhead arranged atop a wellbore, production tubing extending from the wellhead into the wellbore and thereby defining an annulus between the production tubing and an inner wall of a wellbore, and a plurality of fixed injection ports defined in the production tubing. The well system further includes a chemical injection system that includes one or more chemical conduits extending from the wellhead within the annulus and communicably coupled to the plurality of fixed injection ports and thereby placing the one or more chemical conduits in fluid communication with an interior of the production tubing, a chemical injection line in fluid communication with the one or more chemical conduits via the wellhead, and a pump arranged in the chemical injection line to convey one or more chemicals from the chemical storage tank to the production tubing via the one or more chemical conduits.

18 Claims, 2 Drawing Sheets

SYSTEMS AND METHODS OF PRODUCTION TUBING CHEMICAL INJECTION

FIELD OF THE DISCLOSURE

The present disclosure relates generally to the injection of fluids into production tubing of a producing wellbore and, more particularly, to chemical injection into the production tubing by means of permanent injection ports defined in the production tubing.

BACKGROUND OF THE DISCLOSURE

Subterranean hydrocarbon producing wells are primarily completed with some configuration of permanent (or semi-permanent) downhole equipment. As a well produces over time the formation of depositional solids as well as the effects of flowing hydrocarbons can hinder production by detrimentally affecting downhole equipment.

Downhole equipment that is particularly susceptible to the buildup of solids includes electrical submersible pumps (ESP). The formation of asphaltenes, wax, scale, and the like on impellers of an ESP may cause the ESP to experience impeded functionality, deterioration, reduced efficiency, and perhaps even eventual failure. Similarly, prolonged exposure to the flow of hydrocarbons can lead to equipment corrosion and eventual failure. Consequently, operators may utilize chemical injection treatments tailored to address specific needs or concerns with ESPs.

Because chemical treatments and injection may serve to address a range of issues, it is likely that operators will, throughout the life of the well, utilize different chemicals within the same wellbore to treat such varying concerns. Accordingly, the ability to inject targeted treatments efficiently and in a cost effective manner, with a lower risk of harm to the environment and operators, is desirable.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellhead arranged atop a wellbore with production tubing extending into the wellbore and thereby defining an annulus between the production tubing and an inner wall of a wellbore. The production tubing may include a plurality of fixed injection ports defined within. The well system may further include a chemical injection system with one or more chemical conduits extending from the wellhead within the annulus and communicably coupled to the injection ports and thereby placing the chemical conduit(s) in fluid communication with the interior of the production tubing. The chemical injection system may further include a chemical injection line extending from a chemical storage tank and in fluid communication with the chemical conduit(s) via the wellhead, and a pump arranged in the chemical injection line to convey one or more chemicals from the chemical storage tank to the production tubing via the chemical conduit(s).

According to another embodiment consistent with the present disclosure, a method of downhole chemical injection may include drawing one or more chemicals from a chemical storage tank into a chemical injection line fluidly coupled to a wellhead of a wellbore, wherein production tubing extends from the wellhead into the wellbore and thereby defines an annulus between the production tubing and an inner wall of the wellbore. The method may further include conveying the chemical(s) into one or more chemical conduits extending from the wellhead within the annulus. The chemical conduit(s) may be communicably coupled to a plurality of fixed injection ports defined in the production tubing. The chemical(s) may then be conveyed into the interior of the production tubing via the fixed injection ports and are used to enhance hydrocarbon production within the interior of the production tubing.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
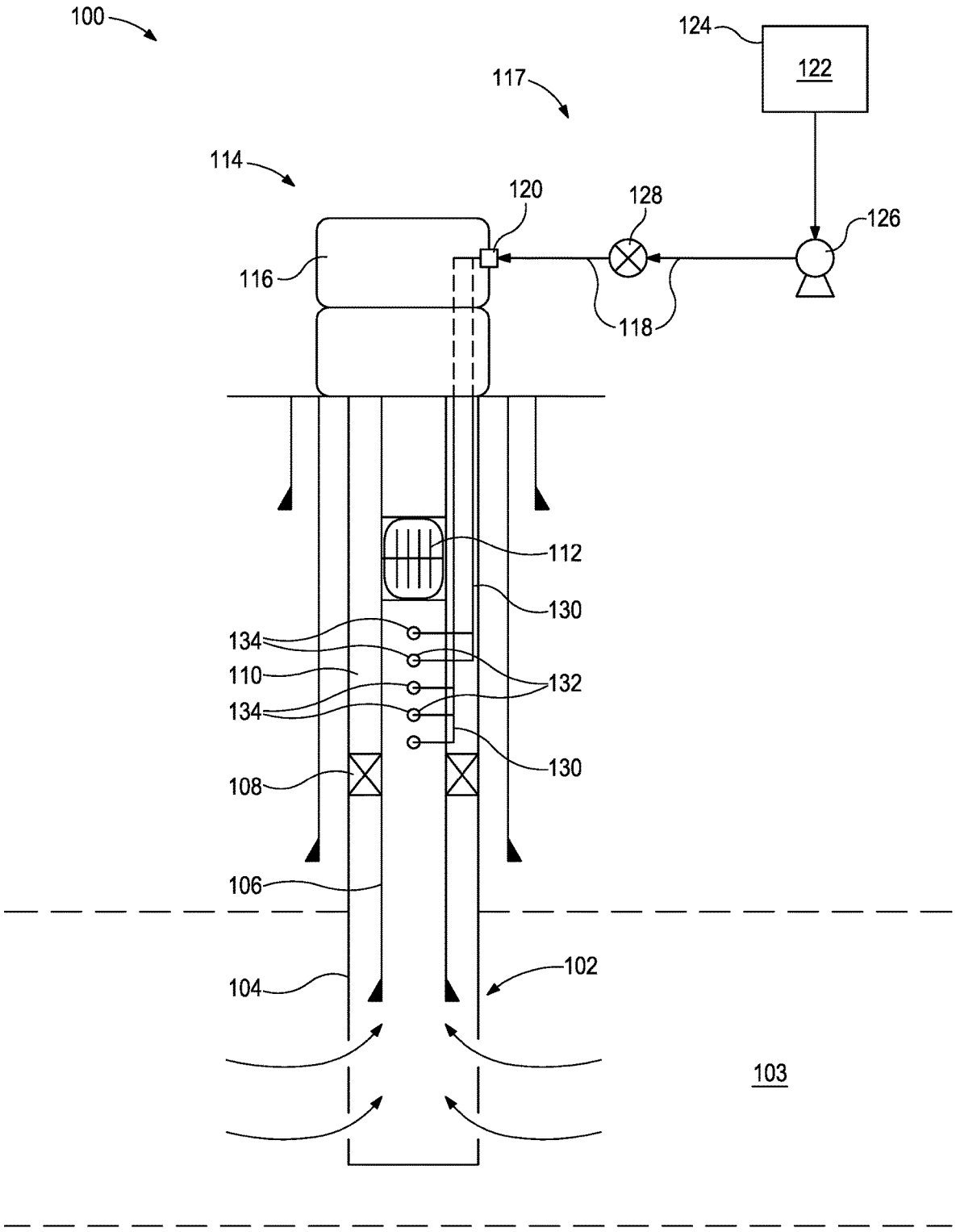
FIG. 1 is a schematic, cross-sectional side view of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the injection of fluids into production tubing of a producing wellbore and, more particularly, to chemical injection by means of permanent injection ports located within production tubing. The chemical injection treatments described herein may be targeted and tailored to address the needs and requirements of the wellbore and equipment deployed within the wellbore. More specifically, the present disclosure describes a chemical injection system that may be employed within a hydrocarbon producing wellbore in which production tubing has been installed. The chemical injection system enables the injection of chemicals directly into the interior of the production tubing via ports that are defined within the body of the production tubing, thus eliminating the need for chemical injection mandrels or utilization of a coiled tubing unit to convey the chemicals.

The system disclosed also allows for the simultaneous injection of multiple chemicals and/or individually via use of chemical conduits emplaced within the production annulus of the wellbore. The systems described herein may be advantageous in facilitating targeted treatment, which cannot be accomplished via conventional bullheading methods and systems.

FIG. 1 is a schematic, partial cross-sectional side view of an example well system 100 that may employ the principles of the present disclosure. As illustrated, the well system 100 includes components of an annular chemical injection system configured to inject fluids into a wellbore 102 via an annulus defined within the wellbore 102. As illustrated, the wellbore 102 extends through various layers of earth strata and into a hydrocarbon-bearing formation 103.

In some applications, as illustrated, the wellbore 102 is lined with a string of casing 104 that extends into the formation 103. The casing 104 includes a plurality of perforations that provide conduits through which formation fluids (e.g., oil, gas, formation water, or some combination thereof) can migrate from the formation 103 into the wellbore 102. In other applications, however, the casing 104 may not extend to the formation 103 and the formation fluids may nonetheless migrate into the wellbore 102.

A string of production tubing 106 may be extended into the wellbore 102 and, more particularly, into the casing 104, and may provide a conduit for extracted formation fluids from the formation 103 to flow to the well surface. A production packer 108 may be deployed toward the distal end of the wellbore 102 at some predetermined distance above (uphole from) the perforations of the formation 103 so as to eliminate the exposure of hydrocarbon fluids to the annulus 110. As illustrated, the production packer 108 may be axially secured between the casing 104 and the production tubing 106, thereby isolating an annulus 110 defined between the casing 104 and the production tubing 106 and above the packer 108. The production packer 108 may be set by means known by those of ordinary skill in the art such that it sealingly engages the inner radial surface of the casing 104 and the outer radial surface of the production tubing 106, thereby creating a barrier that prevents fluid flow from below the packer 108 and into the annulus 110, and vice versa. While FIG. 1 depicts a single production packer 108, the wellbore 102 configuration and producing requirements of the formation 103 may require additional production wellbore packers to isolate multiple producing zones.

The production tubing 106 may include additional internal components dictated by the needs of the wellbore and the requirements of the operator. In the present embodiment, one or more artificial lift pumps 112 (one shown) may be arranged and otherwise deployed within the tubing 106. The artificial lift pump 112 may be configured to pump or convey production fluids derived from the formation 103 uphole through the production tubing 106 and to the well surface for production. Examples of the artificial lift pump 112 include, but are not limited to, an electrical submersible pump (ESP), a progressive cavity pumps (PCP), a rod pump, or any combination thereof.

As illustrated, the artificial lift pump 112 is positioned some distance above (uphole from) the production packer 108. In embodiments where the artificial lift pump 112 comprises an ESP, the ESP may include one or more centrifugal pumps including internal components, such as rotatable impellers and a diffuser operatively connected to a submersible electric motor. The motor is connected to a control system and a source of electric power to drive the impellers to rotate. In operation, the artificial lift pump 112 assists in providing additional lift in producing hydrocarbons to surface via the production tubing 106, thus increasing efficiency and production rate.

The well system 100 further includes a wellhead 114 arranged at the well surface or otherwise atop the wellbore 102. Those of ordinary skill in the art will recognize that the wellhead 114 configuration will include one or more previously installed casing head housings (not shown) and a tubing head housing 116, as may be required by the design of the wellbore 102. In some embodiments, the wellhead 114 may be situated at a wellsite located on the Earth's surface (i.e., a land-based operation), but could alternatively be installed subsea, without departing from the scope of the disclosure. The wellhead 114 may be configured for operation with a water supply well, but could alternatively be configured for operation with a hydrocarbon producing well, without departing from the scope of the disclosure.

In hydrocarbon producing wells, a completed wellbore may contain some configuration of permanent downhole equipment, such as the artificial lift pump 112 that helps with artificial lift and thereby increases the potential rate of hydrocarbon production. During production, the artificial lift pump 112 will be subject to the formation or accumulation of debris and contaminants such as, but not limited to, asphaltenes, wax, scale, and the like (collectively referred to herein as "debris"), which may hinder equipment performance and ultimately slow the rate of production. Similarly, because of its placement (above or uphole from the producing formation 103), the artificial lift pump 112 may be exposed to hydrocarbon flow, and due to the corrosive nature of hydrocarbons, will be subject to corrosion, deterioration, and potential equipment failure. To avoid potential extensive and expensive well intervention operations that could include premature replacement of the artificial lift pump 112, operators may instead utilize chemical injection treatments to remove debris and mitigate detrimental effects of corrosion and/or deterioration to the artificial lift pump 112.

The particular chemical composition and injection location may be dictated by the specific treatment needs and configuration of the wellbore. Often a single wellbore may require chemical injection for one or more of the needs mentioned above. Prior methods of chemical injection have included bullheading and the use of coil tubing. Bullheading chemical injection does not permit targeted chemical treatments, thus is oftentimes not economically efficient. Rather, bullheading typically results in pumping unnecessary volumes of chemical. Similarly, chemical injection via coil tubing requires the use of a coiled tubing unit, which imposes more cost and additional potential risk to personnel as the process requires more surface interaction with large, moving equipment. Accordingly, it may be advantageous to have a system and method that not only accurately and safely positions (injects) multiple chemicals at numerous depths, but also provides continuous access to the production tubing, thus reducing potential trouble-shooting time to the system if and when problems arise. Additionally, a method that is cost effective and less risky to personnel, is particularly prudent for those within the industry.

According to the present disclosure, the well system 100 may further include a chemical injection system 117 operable to selectively inject a variety of chemicals and fluids into the wellbore 102 for a variety of purposes. As illustrated, the chemical injection system 117 may include a chemical injection line 118 in fluid communication with the wellhead 114 and, more particularly, the tubing head housing 116. The chemical injection line 118 may be fluidly coupled to the tubing head housing 116 at one or more surface injection ports 120 that serve as a point of entry for chemicals to be injected into the wellhead 114. Each surface injection port 120 may comprise an orifice milled into the tubing head housing 116.

The chemical injection line 118 serves as the conduit through which one or more chemical(s) 122 may be conveyed to the wellhead 114 to be injected into the wellbore 102. In the present embodiment, a single chemical injection line 118 is disclosed, but the chemical injection system 117 may alternately include two or more chemical injection lines 118, each fluidly coupled to the wellhead 114. In such embodiments, simultaneous injection of two or more chemicals 122 is possible. In the present example, the multiple chemicals 122 may be injected simultaneously or individually into the wellbore 102 using a single chemical injection line 118. Alternatively, or in other embodiments, it may be operationally desirable to employ more than one chemical injection line 118 so as to designate specific chemical injection lines 118 to specific injected chemicals. Such an embodiment would allow for both comingled chemical injection and single chemical injection treatments.

The chemical injection system 117 may further include one or more chemical storage tanks 124 that house or otherwise store the chemical(s) 122 to be injected into the wellbore 102. While FIG. 1 depicts a single chemical storage tank 124, the chemical injection system 117 may alternately include a plurality of chemical storage tanks 124, where each chemical storage tank 124 contains and stores the same or different chemicals 122 for injection. Accordingly, as mentioned above, it is contemplated herein to simultaneously or individually inject two or more chemicals 122. In certain embodiments, chemicals 122 may be mobilized to the wellsite location by means of either truck or barge, depending upon whether the wellsite location is land-based or offshore. In such an embodiment, the chemicals 122 are drawn into the chemical injection line(s) 118 by means of fluid pumps located within the respective vehicles.

The chemical(s) 122 may comprise any chemical composition (liquid or gas) configured to undertake or facilitate various chemical fluid treatments within the wellbore 102. Examples of the chemical(s) 122 include, but are not limited to, an acid, a demulsifier, diesel, xylene, nitrogen, or any combination thereof. The acid may be conveyed as a liquid and may be used to break down hard scale/build up, such as buildup or scale forming on impellers of the artificial lift pump 112. The demulsifier may be conveyed as a liquid and may be used to reverse the emulsion of oil and water in the liquid phase to enhance oil separation that will take place once in the appropriate facility. The diesel may be conveyed as a liquid and may be used to clean solids/scales build up inside the production tubing 106. Xylene may be conveyed as a liquid and may be used to reduce oil thick sludge and reduce the oil density to enable flow to surface. Nitrogen may be conveyed as a gas and may be injected to reduce the fluid hydrostatic column, which provides the production fluid with the required energy to lift oil to the surface.

The chemical injection system 117 may further include a surface pump 126 arranged within the chemical injection line 118 and operable to draw the chemical(s) 122 from the storage tank(s) 124 and convey (pump) the chemical(s) 122 to the wellhead 114 in the requisite dosage and at a rate determined by the well operator. Additionally, one or more one-way check valves 128 may be arranged in the chemical injection line(s) 118 and configured to permit one-way fluid flow and prevent backflow and/or return of the injected chemical(s) 122 through the chemical injection line 118 from the wellbore 102.

The chemical injection system 117 may also include one or more chemical conduit(s) 130 extending from the wellhead 114 and into the annulus 110. The chemical conduit(s) 130 (alternately referred to as the "conduit(s) 130") are operatively and fluidly coupled to the surface injection port(s) 120 and extend downhole within the annulus 110 and toward a distal end of the production tubing 106. Each conduit 130 may terminate and otherwise be fluidly coupled to the production tubing 106 at one or more corresponding downhole injection ports 132 (alternatively referred to as the "ports 132").

In some embodiments, the ports 132 may comprise apertures (orifices) defined in the sidewall of the production tubing 106. In such embodiments, the ports 132 may be drilled directly into the production tubing 106 during the manufacturing stage and prior to delivering the production tubing 106 to the wellsite. In other embodiments, however, the ports 132 may alternatively be drilled into the production tubing 106 at the wellsite as needed, and as the production tubing 106 is being deployed downhole. In yet other embodiments, the injection ports 132 may be provided within a mandrel configured to interpose opposing portions of the string of production tubing 106 and otherwise arranged within the string of production tubing 106 at a predetermined location (depth).

The conduits 130 are operatively and fluidly connected to the ports 132 to permit the direct injection of the chemical(s) 122 into the interior of the production tubing 106. The ports 132 may be positioned where operationally necessary and with a frequency as directed by the well operator, thus providing flexibility in addressing the needs and requirements of the wellbore 102. More specifically, the ports 132 may be arranged at a frequency and interval range suitable to the operations and the wellbore 102.

In some embodiments, as illustrated, the port(s) 132 may be arranged or otherwise provided below (downhole from) the artificial lift pump 112. In other embodiments, or in addition thereto, the port(s) 132 may be arranged above (uphole from) the production packer 108. In either embodiment, the injection of chemical(s) via the ports 132 enables the injected chemical(s) 122 to flow in the same direction as the formation fluid circulating within the interior of the production tubing 106.

In one or more embodiments, a one-way check valve 134 may be arranged within (or at) the ports 132 or within the conduit(s) 130. Each one-way check valve 134 may be operable to prevent the potential backflow of the injected chemical 122 back into the corresponding chemical conduit 130. Similarly, the check valve 134 prevents hydrocarbons (production fluids) flowing within the production tubing 106 from entering the chemical conduit(s) 130.

In embodiments where the artificial lift pump 112 comprises an ESP, the components of the ESP, namely its impellers, may experience a buildup of residue and debris as the wellbore 102 continues to produce hydrocarbons. Positioning the ports 132 downhole from the ESP enables the targeted injection of the chemical(s) 122 to aid in preservation of the ESP such that the chemical 122 upon injection, will flow in the same direction as the formation fluids circulating uphole to surface, across and through the ESP components. In this example, injecting acid as the chemical 122 would be desirable to break down existing residue and debris built up on the impellers of the ESP.

Figure 2:
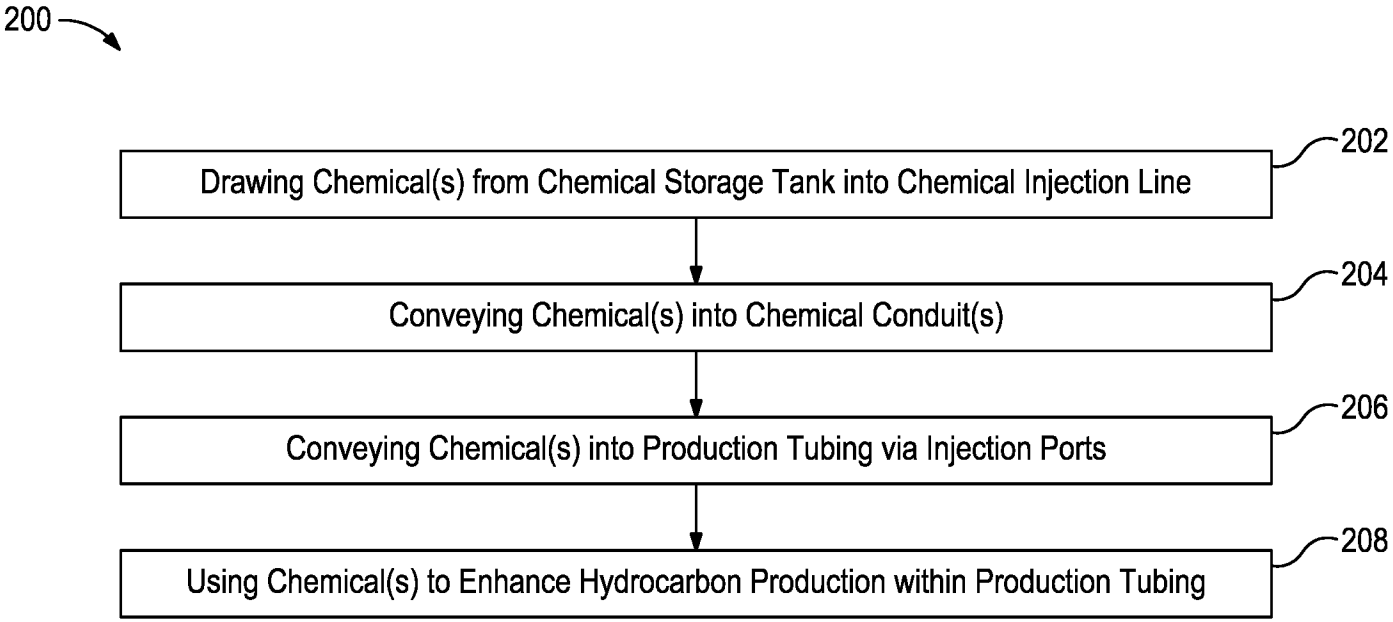
FIG. 2 is a schematic flowchart of an example downhole chemical injection method, according to one or more embodiments of the present disclosure.

Referring now to FIG. 2, with continued reference to FIG. 1, illustrated is a schematic flowchart of an example method 200 of downhole chemical injection, according to one or more embodiments of the present disclosure. The method 200 may include drawing one or more chemicals from a chemical storage tank into a chemical injection line, as at 202. As depicted in FIG. 1, the chemical 122 (or chemicals 122) may be drawn from the storage tank 124 via the pump 126 (arranged within the chemical injection line 118, of which there may be a plurality) and then discharged so that the chemical 122 may be conveyed through the chemical injection line 118 toward the wellhead 114. Pressure supplied by the pump 126 conveys the chemical 122 through the chemical injection line 118 and into the surface injection port 120 (or plurality of surface injection ports 120) defined within the wellhead 114 (more particularly, the tubing head housing 116).

The method 200 may further include conveying the one or more chemicals into one or more chemical conduits extending within the annulus, as at 204. The one or more chemical conduits 130 may be communicably coupled to a plurality of fixed injection ports 120 defined in the production tubing 106. The chemical 122 pumped into the surface injection port 120 may then be conveyed into the chemical conduit 130 operatively and fluidly coupled to the surface injection port 120 defined within the tubing head housing 116. The chemical 122 is then conveyed through the chemical conduit 130 that extends downhole within the annulus 110 defined between the production tubing 106 and an inner wall of the wellbore 102. The conduit(s) 130 may terminate and otherwise be fluidly coupled to the production tubing 106 at one or more corresponding downhole injection ports 132.

The method 200 may further include conveying the one or more chemicals into the interior of the production tubing via the fixed injection ports, as at 206. The pressure from the surface pump 126 may help inject the chemical 122 from the chemical conduit 130 through the downhole injection ports 132 and into the body of the production tubing 106. The injected chemicals 122 may be used to enhance hydrocarbon production within the interior of the production tubing, as at 208. In some embodiments, the chemicals 122 may chemically react with the production fluids flowing within the interior of the production tubing 106 and thereby reduce crude oil and water emulsions in the production fluids. Reducing oil and water emulsions within the production tubing 106 may enhance the oil and water separation operations that may occur when the production fluid is brought to surface. The chemicals 122 may further enhance hydrocarbon production where an artificial lift pump 112 is arranged within the interior of the production tubing 106 and uphole from the plurality of fixed injection ports 132, and the use of the chemicals 122 may reduce debris buildup accumulated on impellers of the artificial lift pump 112.

The placement of the injection ports 132 in the production tubing 106 downhole from the artificial lift pump 112 allows for the injection of acid, which is known to breakdown hard scale and buildup. As it is injected into the interior of the production tubing 106, the acid flows in the same upward (uphole) direction as the hydrocarbons circulating within the interior of the production tubing 106. The acid enters the upward stream of flowing hydrocarbons and reacts with buildup and debris formed on component parts of the artificial lift pump 112. The acid may remove residue and aid in preserving the life of the artificial lift pump 112, ultimately resulting in enhancing the hydrocarbon production rate of the well.

In some embodiments, two or more different chemicals 122 may be injected in varying dosages as prescribed by the well operator either simultaneously or individually. Injecting different chemicals 122 may include injecting the first chemical 122 into the interior of the production tubing 106 at a first dosage and injecting the second chemical 122 into the interior of the production tubing 106 at a second dosage that is different from the first dosage. Injecting different chemicals 122 in different dosage rates may be accomplished by simultaneously injecting both chemicals 122 either via the same chemical conduit 130 or through individual dedicated chemical conduits 130. Alternatively, the injection of different chemicals 122 in different dosage rates may be accomplished by conveying the different chemicals 122 from their respective surface located storage tanks 124 via two or more chemical injection lines 118 in fluid communication with the one or more chemical conduits 130. In certain embodiments, chemical injection system 117 may include an electronic controller (not shown) for at least partially controlling operation, such as rate of chemical injection, rate of chemical mixing, injection amounts and pressures, and so on.

The present embodiment discloses chemical injection treatment for the purpose of equipment preservation and damage mitigation. The example is not intended to be limiting and there are many other embodiments to which this disclosure relates including but not limited to the treatment of formation-related issues and formation fluids as well as improving hydrocarbon production rate. As such, in addition to acid injection (as disclosed in the example above) other injected chemicals include, but are not limited to, demulsifiers, diesel, xylene, nitrogen, and similar chemicals.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellhead arranged atop a wellbore;

production tubing extending from the wellhead into the wellbore and thereby defining an annulus between the production tubing and an inner wall of the wellbore;

one or more fixed injection ports defined in the production tubing and in direct fluid communication with an interior of the production tubing; and a chemical injection system including:

one or more chemical conduits extending from the wellhead within the annulus and directly coupled to the one or more fixed injection ports and thereby placing the one or more chemical conduits in direct fluid communication with the interior of the production tubing;

a chemical injection line extending from a chemical storage tank and in fluid communication with the one or more chemical conduits via the wellhead; and a pump arranged in the chemical injection line and operable to convey one or more chemicals from the chemical storage tank and into the production tubing via the one or more chemical conduits.

2. The well system of claim 1, further comprising an artificial lift pump arranged within the interior of the production tubing and located uphole from the one or more fixed injection ports, wherein the one or more chemicals are injected into the interior of the production tubing to interact with the artificial lift pump.

3. The well system of claim 2, wherein the artificial lift pump is selected from the group consisting of an electrical submersible pump, a progressive cavity pump, a rod pump, and any combination thereof.

4. The well system of claim 1, wherein the one or more chemicals are selected from the group consisting of an acid, a demulsifier, diesel, xylene, nitrogen, and any combination thereof.

5. The well system of claim 1, wherein the one or more chemicals comprise at least two chemicals simultaneously injected into the production tubing via the one or more chemical conduits.

6. The well system of claim 1, wherein the one or more chemicals comprise at least two chemicals and the chemical injection line comprises two or more chemical injection lines in fluid communication with the one or more chemical conduits, and wherein the at least two chemicals are simultaneously injected into the production tubing via the one or more chemical conduits.

7. The well system of claim 1, further comprising a one-way check valve arranged within at least one of the one or more fixed injection ports.

8. The well system of claim 1, wherein the chemical storage tank is positioned on a movable vehicle, and wherein the movable vehicle is one of a truck and a barge.

9. The well system of claim 1, wherein the one or more chemicals comprise first and second chemicals, and the one or more chemical conduits comprise first and second chemical conduits, and wherein the first chemical is injected into the production tubing via the first chemical conduit, and the second chemical is injected into the production tubing via the second chemical conduit.

10. A method of downhole chemical injection, comprising:

drawing one or more chemicals from a chemical storage tank into a chemical injection line fluidly coupled to a wellhead of a wellbore, wherein production tubing extends from the wellhead into the wellbore and thereby defines an annulus between the production tubing and an inner wall of the wellbore;

conveying the one or more chemicals into one or more chemical conduits extending from the wellhead within the annulus and directly coupled to one or more fixed injection ports defined in the production tubing, thereby placing the one or more chemical conduits in direct fluid communication with the interior of the production tubing;

conveying the one or more chemicals directly into the interior of the production tubing via at least one of the one or more fixed injection ports; and using the one or more chemicals to enhance hydrocarbon production within the interior of the production tubing.

11. The method of claim 10, wherein conveying the one or more chemicals into the interior of the production tubing comprises flowing the one or more chemicals in the production tubing in the same direction as formation fluid circulating within the interior of the production tubing.

12. The method of claim 10, wherein the one or more chemicals comprise a first chemical and a second chemical different from the first chemical, the method further comprising:

injecting the first chemical into the interior of the production tubing at a first dosage; and injecting the second chemical into the interior of the production tubing at a second dosage different from the first dosage.

13. The method of claim 12, further comprising simultaneously injecting the first and second chemicals into the interior of the production tubing via the same chemical conduit of the one or more chemical conduits.

14. The method of claim 12, wherein the one or more chemical conduits include a first chemical conduit and a second chemical conduit, the method further comprising:

injecting the first chemical into the interior of the production tubing via the first chemical conduit; and injecting the second chemical into the interior of the production tubing via the second chemical conduit.

15. The method of claim 10, wherein an artificial lift pump is arranged within the interior of the production tubing uphole from the one or more of fixed injection ports, and wherein using the one or more chemicals comprises reducing debris buildup accumulated on impellers of the artificial lift pump with the one or more chemicals.

16. The method of claim 10, wherein using the one or more chemicals to enhance hydrocarbon production within the interior of the production tubing comprises chemically reacting the one or more chemicals with production fluids flowing within the interior and thereby reducing crude oil and water emulsions in the production fluids.

17. The method of claim 10, wherein the one or more chemicals comprise at least two chemicals, and wherein conveying the one or more chemicals into the interior of the production tubing comprises simultaneously injecting the at least two chemicals into the production tubing via the one or more chemical conduits.

18. The method of claim 10, wherein the one or more chemicals comprise at least two chemicals and the chemical injection line comprises two or more chemical injection lines in fluid communication with the one or more chemical conduits, and wherein conveying the one or more chemicals into the interior of the production tubing comprises simultaneously injecting the at least two chemicals into the production tubing via the one or more chemical conduits.

* * * * *